US006837721B2

(12) United States Patent
Soeta

(10) Patent No.: US 6,837,721 B2
(45) Date of Patent: Jan. 4, 2005

(54) DETACHABLE CONNECTOR DEVICE

(75) Inventor: Kaoru Soeta, Kanagawa-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/654,705

(22) Filed: Sep. 3, 2003

(65) Prior Publication Data

US 2004/0110399 A1 Jun. 10, 2004

(30) Foreign Application Priority Data

Sep. 27, 2002 (JP) ..... 2002-283506

(51) Int. Cl.[7] ..... H01R 12/00
(52) U.S. Cl. ..... 439/82
(58) Field of Search ..... 439/82, 70, 84, 439/66, 83, 65, 91; 29/830, 847, 832, 852; 324/757, 765; 361/769, 767, 761, 771; 174/263, 257

(56) References Cited

U.S. PATENT DOCUMENTS 5,812,378 A * 9/1998 Fjelstad et al. ..... 361/769
6,402,531 B1 * 6/2002 Legrady ..... 439/83
6,517,362 B2 2/2003 Hirai et al.
6,617,528 B2 * 9/2003 Armezzani et al. ..... 174/263

* cited by examiner

*Primary Examiner*—Alex Gilman
(74) *Attorney, Agent, or Firm*—Beyer, Weaver & Thomas, LLP

(57) ABSTRACT

In order to be able to prevent devices from being degraded in high frequency property and to prevent damages to respective junction terminals, thereby achieving lengthening of the junction terminals in service life, a connector device comprising a plurality of substantially semi-spherical junction terminals arranged on one surface of a board, substantially semi-spherical junction terminals arranged in positions on the other surface of the board, corresponding to those positions, in which the respective junction terminals are arranged, to be conducted to the respective junction terminals, and a plurality of contactors corresponding to the respective junction terminals, and wherein the respective contactors comprise a through-hole and contact pieces arranged in the through-hole, and each of the junction terminals are inserted into the through-hole whereby a surface of each of the junction terminals is brought into contact with surfaces of the contact pieces.

2 Claims, 6 Drawing Sheets

DETACHABLE CONNECTOR DEVICE

BACKGROUND OF THE INVENTION

1. Field of the Invention

The present invention relates to a connector device, and more particular, to a detachable connector device.

2. Description of the Related Art

Conventionally, connector devices are frequently used as means for electrically connecting a computer device, such as personal computers, portable equipments, and so on, to a computer peripheral device, such as PC cards, communication modem cards, memory cards, and so on.

Such connector devices comprise a housing, in which a plurality of junction terminals composed of a plate spring or the like are arranged (for example, Patent document 1).

And a computer device mounts thereon the connector device, and by inserting a computer peripheral device into the housing, a plurality of electrode terminals aligned and arranged on one surface of an end portion of the computer peripheral device are brought into the respective junction terminals whereby the computer device and the computer peripheral device are electrically connected to each other.

Also, other connector devices having a plurality of pin-shaped junction terminals are conventionally known, and the junction terminals of such connector device are inserted into a plurality of openings formed on one end surface of a computer peripheral device whereby a computer device and the computer peripheral device are electrically connected to each other (for example, Patent document 2).

[Patent document 1]

Japanese Unexamined Published Patent Application No. 2001-338722

[Patent document 2]

Japanese Utility Model No. 3086612

Since respective junction terminals in the connector device are composed of lengthy plate springs, pin configurations, or the like, however, dimensions, over which the respective junction terminals and the respective electrode terminals contact with each other, are increased. Therefore, impedance constitutes an inhibition, and a CPU driven by high frequency of, for example, 2.4 GHz or higher is degraded 1 db or more in high frequency in the case where a computer device, in which the CPU is arranged, and a computer peripheral device are connected to each other by means of a conventional connector device. As a result, the CPU involves a problem that it is difficult to adequately exhibit its performance.

Also, in order to achieve stable connection of the connector device, pressure in the order of 20 to 30 gf per one junction terminal is conventionally applied on the respective junction terminals whereby the respective junction terminals and the respective contactors are connected to each other. Therefore, pressure applied to the respective junction terminals at the time of connection of the connector device is large to cause damages to the respective junction terminals with the result that the respective junction terminals become short in service life. Here, in order to solve the problem, lengthening of the respective junction terminals is achieved by applying gold plating of about 0.7 $\mu$m to, for example, outer sides of the respective junction terminals to protect the outer sides of the respective junction terminals. When gold plating of the above thickness is applied to the respective junction terminals, however, there is caused a problem that an increase in manufacturing cost of the connector device is incurred.

SUMMARY OF THE INVENTION

The invention has been thought of in view of these points and has its object to provide a detachable connector device capable of preventing connected devices from being degraded in high frequency property and preventing damages to respective junction terminals, thereby achieving lengthening of the junction terminals in service life.

In order to solve the above problem, the invention provides a connector device comprising a plurality of convex-shaped junction terminals arranged on one surface of a board, a plurality of further convex-shaped junction terminals arranged in positions corresponding to those positions, in which the respective junction terminals are arranged, on the other surface of the board to be conducted to the respective junction terminals, and a plurality of contactors corresponding to the respective junction terminals, the respective contactors comprising an opening and a contact piece arranged inside the opening, and the respective junction terminals being inserted into the openings of the respective contactors whereby a surface of the respective junction terminals and a surface of the contact piece are brought into contact with each other.

Here, an opening is a concept including a bottomed hole and a through-hole.

With the connector device according to the invention, a surface of the respective junction terminals and the contact piece can contact with each other over a short dimension of contact, and so a linear dimension, over which the respective junction terminals and the contact piece of the respective contactors are connected to each other, can be made short as compared to the conventional insertion type connector, whereby it is possible to reduce impedance, thereby enabling preventing various devices or the like, in which the connector device is used, from being degraded in high frequency property.

Also, portions, in which the respective junction terminals and the respective contactors are connected to each other, are not plugged by, for example, solder or the like, and the respective junction terminals and the respective contactors are brought into contact with each other to be thereby electrically connected to each other, so that it is possible to improve dissipation of heat radiated from devices as connected since an air is present in gaps between the respective junction terminals and the respective contactors.

Also, with a further connector device according to the invention, the respective contactors are brought at a plurality of contacts into contact with the respective junction terminals.

With a further connector device according to the invention, the respective junction terminals and the respective contactors are brought into contact with each other at many points, so that in connecting the respective junction terminals and the respective contactors together, pressure applied to one junction terminal can be reduced as compared with the prior art to achieve stable connection. Therefore, it is possible to prevent damages to the respective junction terminals, thereby enabling achieving lengthening of various devices, in which the connector device is used, in service life. Further, since there is no need of increasing the thickness of gold plating applied on surfaces of the respective junction terminals, it is possible to suppress an increase in manufacturing cost of the devices or the like.

Also, the invention provides a further connector device, in which the respective junction terminals are formed to be made gradually small toward a tip end thereof, and the respective contactors comprise a plurality of contact pieces each comprising a contact portion formed to be inclined toward an internal center of the opening from an outer edge of the opening on a surface side of the opening to contact with each of the junction terminals, and an abutting portion extended from a tip end of the contact portion to be bent toward a bottom of the opening and opposite to a direction of the inclination and to abut against a conductive film formed on an inner side surface of the opening when each of the junction terminals is inserted into the opening of each of the contactors.

With the further connector device according to the invention, since various devices or the like, in which the connector device is used, can be prevented from being degraded in high frequency property, and the respective junction terminals are inserted into the respective opening while bringing their surfaces into sliding contact with the contact portions of the respective contact pieces, it is possible to remove oxide films formed on surfaces of the respective junction terminals and the contact portions of the respective contact pieces. Thereby, it is possible to surely bring the respective junction terminals and the respective contact pieces into contact with each other, and to have various devices, in which the connector device is used, further exhibiting their high frequency properties.

Also, a further connector device according to the invention has a feature in that the respective contactors comprises four contact pieces positioned to be spaced 90 degrees from one another at an outer edge of an opened portion on a surface side of the opening and to be formed toward the internal center of the respective openings from four directions.

With the further connector device according to the invention, four contact pieces are arranged on the contactor, so that it is possible to more surely bring the respective junction terminals into the contact portions of the respective contact pieces to achieve stable connection.

Also, a further connector device according to the invention has a feature in that the respective contact pieces comprise a plurality of small projections provided on the contact portion to project toward the opened portion on the surface side of the opening.

With the further connector device according to the invention, a linear dimension, over which the respective junction terminals are connected to the respective contactors, can be further shortened to be made a dimension, over which the respective junction terminals contact with the small projections, so that it is possible to reduce impedance.

Also, a further connector device according to the invention has a feature in that the respective junction terminals are formed to be in the form of an elongated rectangular solid, and the respective contactors comprise a contact piece in the form of an elongated rectangular solid, arranged in an opened portion on a surface side of the opening to be perpendicular to each of the junction terminals and connected to a conductive film formed on an inner side surface of the opening.

With the further connector device according to the invention, each of the junction terminals is arranged to be perpendicular to the contact piece of each of the contactors, so that a surface of each of the junction terminals and a surface of the contact piece of each of the contactors can be brought into contact with each other, and a linear dimension, over which each of the junction terminals is connected to the contact piece of each of the contactors, can be made small as compared with that in conventional insertion-type connectors whereby it is possible to reduce impedance. Thereby, it is possible to prevent various devices or the like, in which the connector device is used, from being degraded in high frequency property.

Also, a further connector device according to the invention has a feature in that the contact piece is arranged in a position disposed inside the opening the same dimension as that, by which each of the junction terminals projects from a surface of the opened portion on the surface side of the opening.

With the further connector device according to the invention, each of the junction terminals is inserted into the opening, so that each of the junction terminals and each of the contactors can be brought into contact with each other, whereby it is possible to prevent the respective junction terminals and the respective contactors from being positionally offset from each other.

Further, a further connector device according to the invention has a feature in that the respective junction terminals are formed to become gradually small toward a tip end thereof, and the contact piece of the respective contactors is formed to be spiral in planar shape.

With the further connector device according to the invention, since various devices or the like, in which the connector device is used, can be prevented from being degraded in high frequency property, and the respective junction terminals are inserted into the respective opening while bringing their surfaces into sliding contact with the contact portions of the respective contact pieces, it is possible to remove oxide films formed on surfaces of the respective junction terminals and the contact portions of the respective contact pieces. Thereby, it is possible to surely bring the respective junction terminals and the respective contact pieces into contact with each other, and to have various devices, in which the connector device is used, further exhibiting their high frequency properties.

DESCRIPTION OF THE PREFERRED EMBODIMENTS

Embodiments of a connector device according to the invention will be described below with reference to FIGS. 1 to 12.

Figure 1:
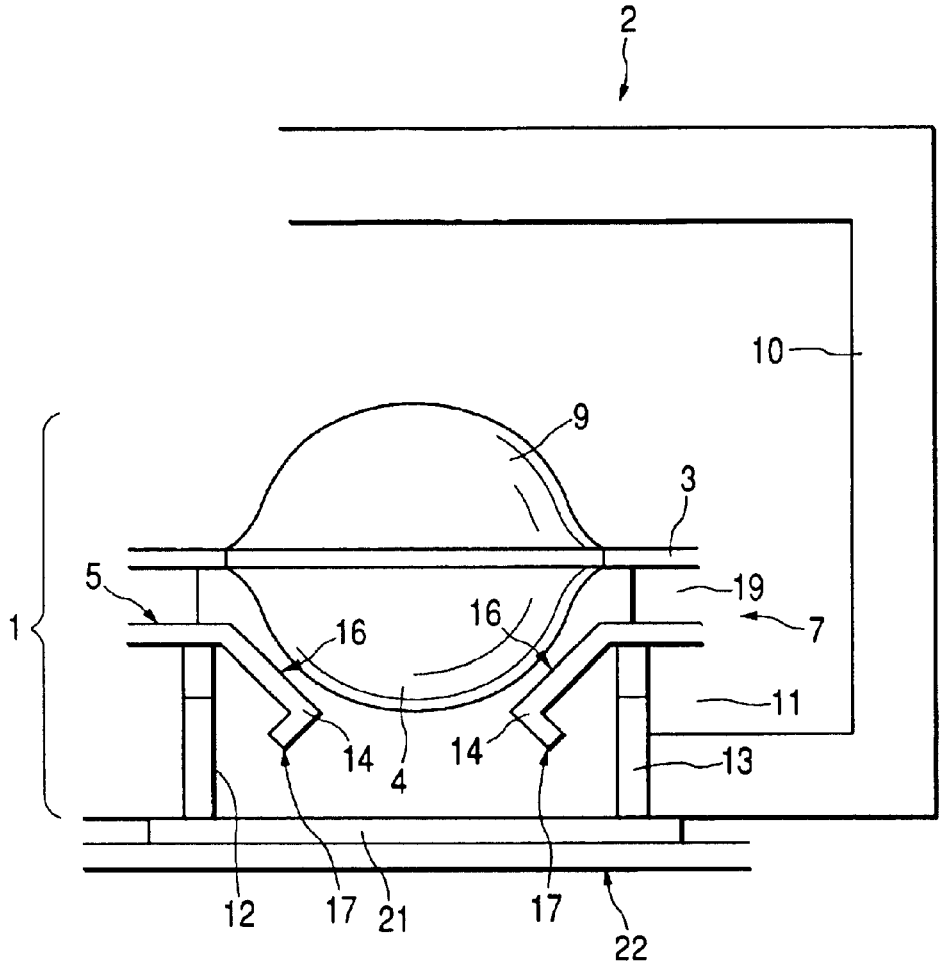
FIG. 1 is a cross sectional view showing a part of a connector device according to a first embodiment of the invention.
Figure 2:
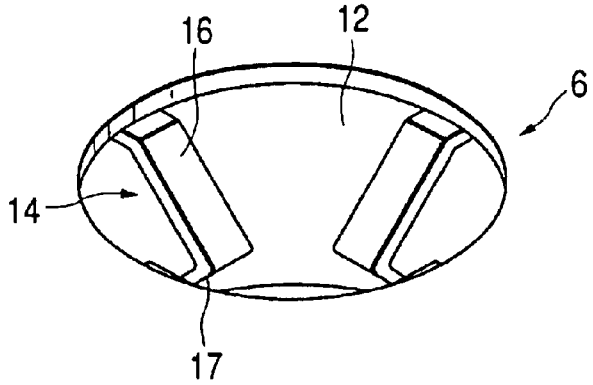
FIG. 2 is a perspective view showing a contactor constituting the connector device shown in FIG. 1.

FIG. 1 is across sectional view showing apart of a connector device according to a first embodiment of the invention, and FIG. 2 is a perspective view showing a contactor constituting a socket of the connector device shown in FIG. 1. Here, the embodiment will be described byway of a connector device for connecting a computer device and a computer peripheral device to each other.

As shown in FIG. 1, a connector device 1 having a housing 10, into which a computer peripheral device 25 is inserted, is arranged in a computer device 2, in which the connector device 1 according to the embodiment is used, and a board 3 having a plurality of substantially semi-spherical junction terminals 4 aligned and arranged on one surface thereof is arranged in the housing 10. Also, a plurality of substantially semi-spherical junction terminals 9 are aligned and arranged in positions corresponding to those positions, in which the respective junction terminals 4 are arranged, on the other surface of the board 3. And these respective junction terminals 4, 9 are formed by using a conductive material, such as gold, silver, or the like to apply thin-film plating on a surface of a core portion, which is formed from a conductive material, such as copper, nickel, or the like.

Also, a plurality of contactors 6 corresponding to the respective junction terminals 4 are arranged on that side surface, on which the respective junction terminals 4 are arranged, on the board 2 in the housing 10.

These respective contactors 6 comprise a through-hole 12, which serves as an opening being circular in planar shape as shown in FIG. 2 and is positioned to correspond to each of the junction terminals 4 on a substrate 11 constituting interposers 5, and a conductive film 13 made of a conductive material, such as copper or the like, is formed on a side of the through-hole 12. Further, the respective contactors 6 comprise contact pieces 14 spaced 90 degrees from one another on an outer edge of an opened portion on a surface side of the respective through-holes 12 and formed to be inclined toward an interior center of the respective through-holes 12 from four directions, and tip end portions of the respective contact pieces 14 are bent in a direction toward a bottom of the respective through-holes 12 and in an opposite direction to the direction of inclination. And that portion of the respective contact pieces 14, which is inclined toward the interior center of the respective through-holes 12 and contacts with each of the contact pieces 14 when the respective junction terminals 4 are inserted into the respective contactors 6, defines a contact portion 16, and the respective contact portions 16 in the embodiment are formed to have a linear dimension of 10 to 15 $\mu$m. Also, the tip portion of the respective contact pieces 14, which abuts against the side of the through-hole 12 when the contact portions 16 of the respective contact pieces 14 contact with the respective junction terminals 4 to be pressed thereby, defines an abutting portion 17.

In addition, the respective contactors 6 in the embodiment comprise four contact pieces 14 but are not limited thereto and may comprise at most three or at least five as far as the respective contactors comprise a plurality of contact pieces.

Also, a spacer 19 made of an elastic material such as elastomer, rubber, or the like is arranged on a surface of the substrate 11, and the board 3 is arranged in a manner to abut against a surface of the spacer 19 on the interposer 5 in the housing 10.

At this time, the spacer 19 is formed to have such a thickness to cause no contact between the respective junction terminals 4 and the respective contact pieces 14 in a state, in which the computer peripheral device 25 is inserted into the housing 10 of the computer device 2, and the interposers 5 are formed to have a thickness of 60 $\mu$m.

Also, a printed circuit board 22 provided at a surface thereof with a plurality of wirings 21 is arranged on a bottom surface side of the connector device 1 in the computer device 2 in such a manner that the respective wirings 21 abut against the conductive films 13 of the respective interposers 5, and the respective conductive films 13 and the respective wirings 21 are soldered together by, for example, flow solder or the like. And the connector device 1 and the computer device 2 are electrically connected to each other thereby.

Subsequently, an explanation will be given to an operation of the embodiment.

Figure 3:
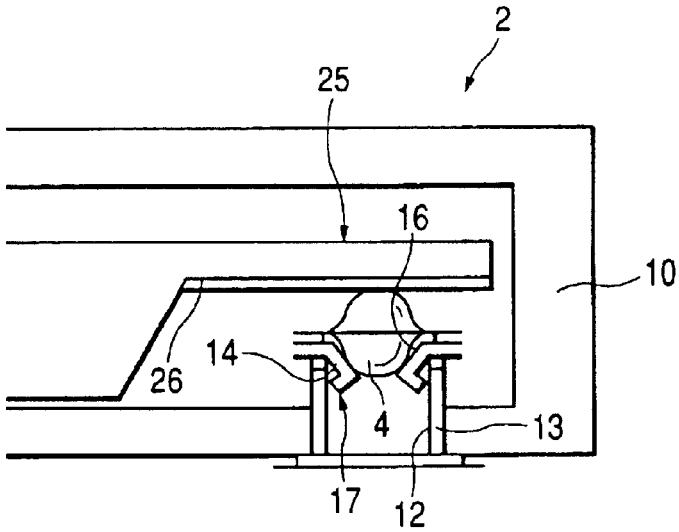
FIG. 3 is a conceptual view showing the case where a computer peripheral device is inserted into a computer device, in which the connector device shown in FIG. 1 is used.
Figure 4:
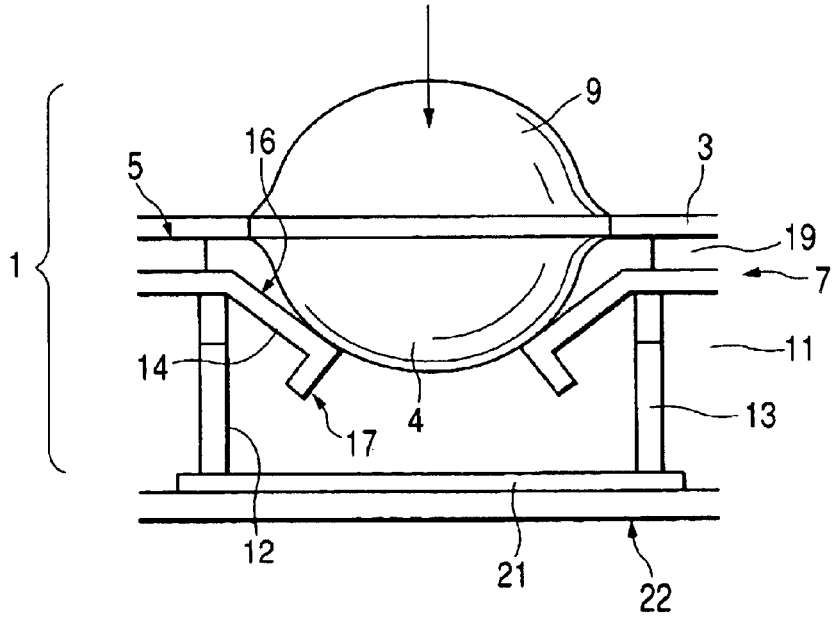
FIG. 4 is a cross sectional view showing the step, in which respective junction terminals of the connector device shown in FIG. 1 are inserted into respective contactors.
Figure 5:
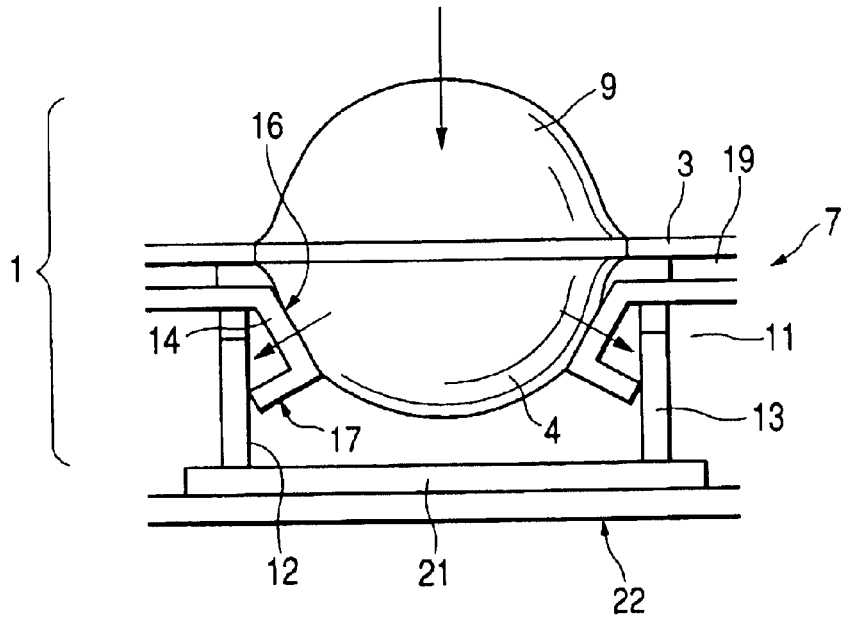
FIG. 5 is a cross sectional view showing the step, in which respective junction terminals of the connector device shown in FIG. 1 are inserted into respective contactors.

First, when the computer peripheral device 25 is inserted into the housing 10 as shown in FIG. 3, the respective junction terminals 9 are pushed toward the through-holes 12 of the respective contactors 6 as shown in FIG. 4 while their tip ends come into sliding contact with a plurality of electrode terminals 26 arranged on one end portion of the computer peripheral device 25. Correspondingly, the respective junction terminals 4 are pushed inward in the respective through-holes 12 by the elasticity of the spacer 19, so that tip ends of the respective junction terminals 4 come into elastic contact with the contact portions 16 of the respective contact pieces 14 of the respective contactors 6. Subsequently, when the respective junction terminals 4 are pushed inward in the respective through-holes 12 as they are, they are surely inserted into the respective through-holes 12 while surfaces of the respective junction terminals 4 come into sliding contact with the contact portions 16 of the respective contact pieces 14. Then, when the computer peripheral device 25 has been surely inserted into the housing 10, the abutting portions 17 of the respective contact pieces 14 are moved toward the inner side of the respective through-holes 12 as shown in FIG. 5 as the contact portions 16 of the respective contact pieces 14 are pushed by the respective junction terminals 4, and then the abutting portions 17 of the respective contact pieces 14 abut against the conductive film 13 on the inner side of the respective through-holes 12.

In this manner, by inserting the computer peripheral device 25 into the housing 10, it is possible to bring the respective electrode terminals 26 of the computer peripheral device 25 into contact with tip ends of the respective junction terminals 9 and to bring the respective junction terminals 4 into indirect contact with the respective wirings 21 of the printed circuit board 22 through the respective contact pieces 14 and the conductive film 13. Thereby, it is possible to bring the computer peripheral device 25 and the computer device 2 into electrical contact with each other.

While a linear dimension, over which the respective junction terminals 9 are connected to the respective electrode terminals 26 of the computer peripheral device 25 in conventional connector devices, is in unit of several mm, a linear dimension, over which the respective junction terminals 9 are connected to the respective electrode terminals 26, and a linear dimension, over which the respective junction terminals 4 are connected to the respective contact pieces 14 of the respective contactors 6, can be decreased according to the embodiment to be made 100 μm or less, so that it is possible to reduce impedance. Thereby, it is possible to prevent the computer device 2 from being degraded in high frequency property.

Accordingly, it is possible to have the computer device 2 adequately exhibiting its high frequency property whereby it is possible to make data communication between the computer device 2 and the computer peripheral device 25 at high speeds to efficiently drive the computer device 2.

Also, since the respective junction terminals 4 and the respective contactors 6 contact with each other at many points, pressure applied per one junction terminal 4 can be decreased to 10 gram or less as compared with that in the conventional art when the respective junction terminals 4 are to be connected to the respective contactors 6. Therefore, it is possible to prevent damages to the respective junction terminals 4, thereby enabling achieving lengthening of the connector device 1 in service life. Further, since there is no need of increasing the thickness of gold plating applied on surfaces of the respective junction terminals 4, it is possible to suppress an increase in manufacturing cost of the connector device 1.

Further, since when the computer peripheral device 25 is inserted into the housing 10, the respective junction terminals 9 come into contact with the respective electrode terminals 26 while bringing the tip end portions of the respective junction terminals 9 into sliding contact with the respective electrode terminals 26 of the computer peripheral device 25, it is possible to remove oxide films formed on surfaces of the respective junction terminals 9 and the respective electrode terminals 26. Simultaneously therewith, the respective junction terminals 4 are inserted into the respective through-holes 12 while bringing their surfaces into sliding contact with the contact portions 16 of the respective contact pieces 14, so that it is possible to remove oxide films formed on surfaces of the respective junction terminals 4 and the contact portions 16 of the respective contact pieces 14. Thereby, it is possible to surely bring the respective junction terminals 4 and the respective contact pieces 14 into contact with each other, and to have the computer device 2 further exhibiting its high frequency property.

Moreover, since four contact pieces are provided on the respective contactors 6, the respective junction terminals 4 can be more surely brought into contact with the contact portions 16 of the respective contact pieces 14.

Further, since connections of the respective junction terminals 4 and the respective contactors 6 are not plugged by, for example, solder or the like and an air is present in gaps between the respective junction terminals 4 and the respective contactors 6, it is possible to improve dissipation of heat radiated from the computer device 2.

Figure 6:
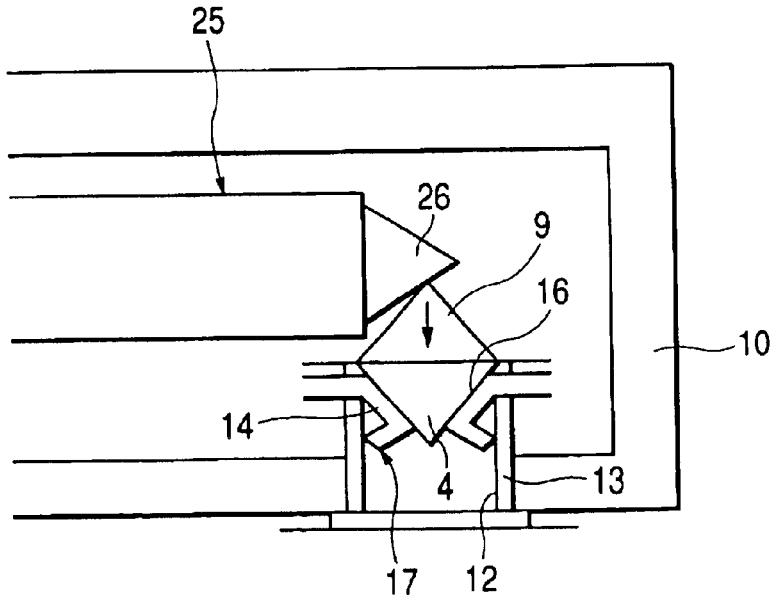
FIG. 6 is a conceptual view showing the case where a computer peripheral device is inserted into a computer device, in which a further connector device according to the embodiment of the invention is used.

Also, FIG. 6 is a cross sectional view showing the case where a connector device according to the embodiment is used for connection with a computer peripheral device, which comprises insertion type (pin type) junction terminals, and the respective junction terminals 4, 9 of the connector device are formed to be cone-shaped as shown in FIG. 6.

And when the computer peripheral device 25 is inserted into the housing 10 of the computer device 2, tip ends of a plurality of cone-shaped electrode terminals 26 arranged on one end surface of the computer peripheral device 25 abut against tip ends of the respective junction terminals 9, so that the respective junction terminals 9 are pushed toward the through-holes 12. Accordingly, the respective junction terminals 4 are pushed inward into the through-holes 12 to contact with the respective contact pieces 14. Correspondingly, the abutting portions 17 of the respective contact pieces 14 abut against the conductive film 13 on the inner side of the respective through-holes 12. Thereby, it is possible to bring the computer peripheral device 25 and the computer device 2 into electrical contact with each other.

Subsequently, an explanation will be given to a second embodiment of a connector device according to the invention with reference to FIGS. 7 and 8.

Figure 7:
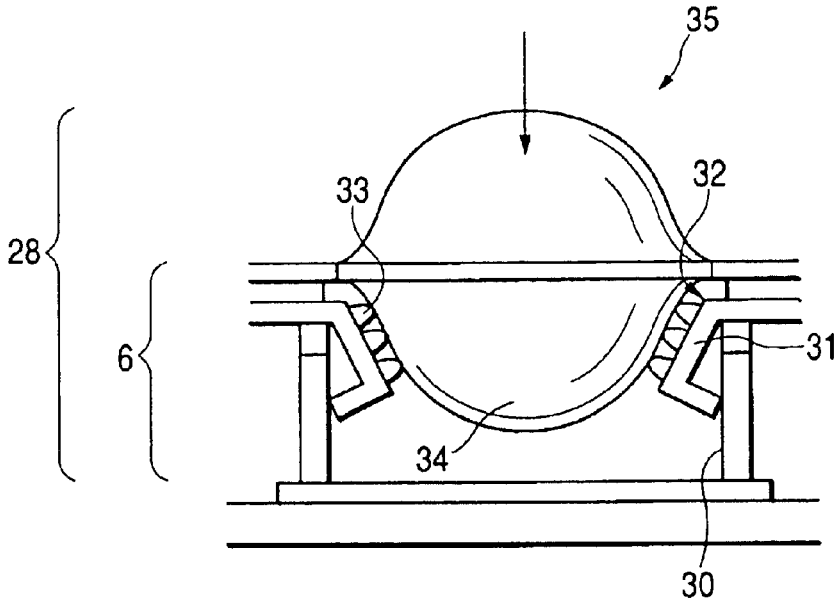
FIG. 7 is a cross sectional view showing a part of a connector device according to a second embodiment of the invention.

FIG. 7 is across sectional view showing a part of a connector device according to the embodiment, and respective contactors 29 constituting the connector device 28 comprises contact pieces 31 formed to be inclined inwardly of respective through-holes 30 from an outer edge on a surface side of the respective through-holes 30 in the same manner as in the first embodiment. Also, arranged on a contact portion 32 of the respective contact pieces 31 are a plurality of small projections 33 made of a conductive material to project toward an opening on the surface side of the respective through-holes 30.

In addition, the remaining constitution of the embodiment is the same as that of the first embodiment, and so an explanation therefor is omitted.

Subsequently, an explanation will be given to an operation of the second embodiment.

First, when the respective junction terminals 34 are inserted into the through-holes 30 of the respective contactors 29, tip ends of the respective junction terminals 34 come into elastic contact with tip end portions of the respective small projections 33 on the respective contact pieces 31 of the respective contactors 29. Subsequently, when the respective junction terminals 34 are pushed inward in the respective through-holes 30 as they are, they are surely inserted into the respective through-holes 30 while surfaces of the respective junction terminals 34 come into sliding contact with the respective small projections 33.

According to the embodiment, a linear dimension, over which the respective junction terminals 34 are connected to the respective contactors 29, can be made a dimension, over which the respective junction terminals 34 are brought into contact with the tip end portions of the respective small projections 33, and can be further decreased as compared with the first embodiment, so that it is possible to further reduce impedance.

Accordingly, it is possible to have a computer device 35 adequately exhibiting its high frequency property whereby it is possible to make data communication between the computer device 35 and a computer peripheral device at higher speeds to efficiently drive the computer device 35.

Subsequently, an explanation will be given to a third embodiment of a connector device according to the invention with reference to FIGS. 8 and 9.

Figure 8:
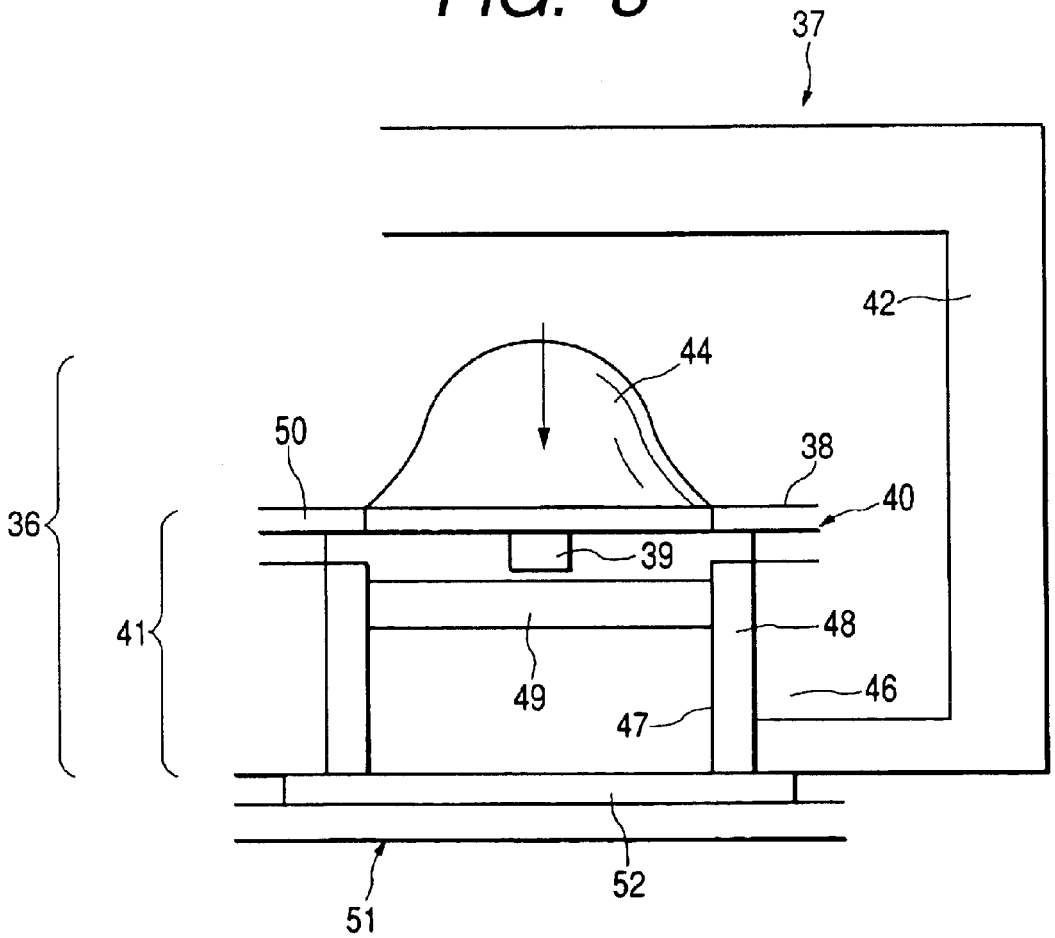
FIG. 8 is a cross sectional view showing a part of a connector device according to a third embodiment of the invention.
Figure 9:
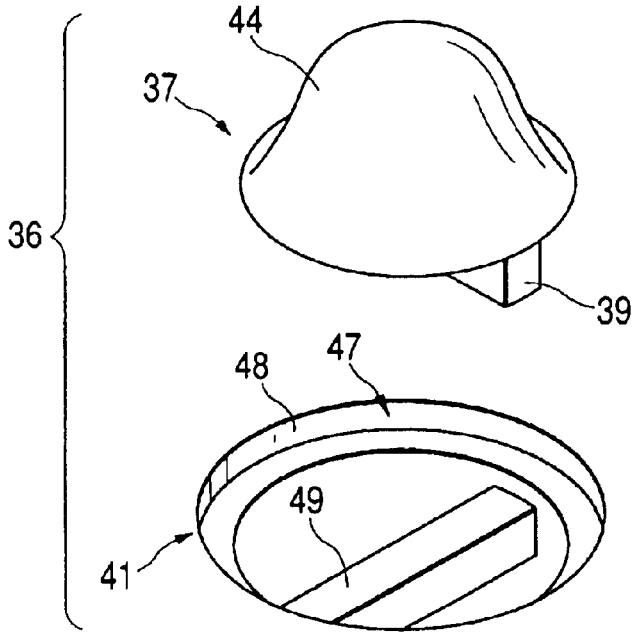
FIG. 9 is a perspective view showing a contactor constituting the connector device shown in FIG. 8.

FIG. 8 is across sectional view showing a part of a connector device according to the embodiment, and FIG. 9 is a perspective view showing the connector device shown in FIG. 8. Also, the embodiment will be described by way of a connector device for connecting a computer device and a computer peripheral device to each other.

As shown in FIG. 8, arranged in a housing 42 of that computer device 37, in which a connector device 36 according to the embodiment is used, is a board 38 having a plurality of junction terminals 39 arranged on a surface thereof, the respective junction terminals 39 being in the form of an elongated rectangular solid and formed to project a small projecting dimension. Also, a plurality of substantially semi-spherical junction terminals 44 are aligned and arranged in positions corresponding to those positions, in which the respective junction terminals 39 are arranged, on the other surface of the board 38.

Also, a plurality of contactors 41 corresponding to the respective junction terminals 39 are arranged on a side of the board 38, on which the respective junction terminals 39 are arranged, in the housing 42.

These respective contactors 41 comprise a through-hole 47, which is circular in planar shape as shown in FIG. 9 and is positioned to correspond to each of the junction terminals 39 in a substrate 46 constituting an interposer 40, and a conductive film 48 is formed on a side of the through-hole 47. Further, a contact piece 49 in the form of an elongated rectangular solid, bridged between an outer edge of the respective through-holes 47 and an outer edge on an opposite side thereof is arranged in an opened portion on a surface side of the through-hole 47 to be perpendicular to the respective junction terminals 39, both ends of such contact piece 49 being connected to the conductive film 48. Also, the contact piece 49 is arranged with a surface thereof positioned inside the through-hole 47 a little larger dimension than that, by which the respective junction terminals 39 project from a surface of the interposer 40, and the respective junction terminals 39 are formed to have a length equal to or a little smaller than a diameter of the respective through-holes 47.

Also, a spacer 50 made of an elastic material is arranged on a surface of the substrate 46, and the board 38 is arranged in the housing 42 to abut against a surface of the spacer 50 for the interposers 40. At this time, surfaces of the respective junction terminals 39 are not in contact with surfaces of the contact pieces 49.

In addition, the remaining constitution of the embodiment is the same as that of the first embodiment, and so an explanation therefor is omitted.

Subsequently, an explanation will be given to an operation of the embodiment.

First, when a computer peripheral device is inserted into the housing 42 of the computer device 37, the respective junction terminals 44 are pushed toward the respective through-holes 47 by respective electrode terminals of the computer peripheral device. Correspondingly, the respective junction terminals 39 are pushed inward in the respective through-holes 47 by the elasticity of the spacer 50, so that surfaces of the respective junction terminals 39 come into contact with surfaces of the respective contact pieces 49. And the respective junction terminals 39 of the computer device 37 are connected indirectly to respective wirings 52 of a printed circuit board 51 through the respective contact pieces 49 and the conductive films 48, whereby it is possible to bring the computer peripheral device and the computer device 37 into electrical contact with each other.

While a linear dimension, over which respective junction terminals are connected to respective connectors in conventional connectors, is in unit of several mm, a linear dimension, over which the respective junction terminals 44 are connected to the respective electrode terminals of the respective computer peripheral device, and a linear dimension, over which the respective junction terminals 39 are connected to the respective contact pieces 49 of the respective contactors 41, can be decreased according to the embodiment to be made 100 $\mu$m or less, so that it is possible to reduce impedance and thereby it is possible to prevent the computer device 37 from being degraded in high frequency property.

Also, the respective junction terminals 39 and the contact pieces 49 of the respective contactors 41 are arranged to be perpendicular to each other, whereby surfaces of the respective junction terminals 39 and surfaces of the contact pieces 49 of the respective contactors 41 are caused to come into contact with each other, so that it is possible to bring the respective junction terminals 39 and the contact pieces 49 into contact with each other at large areas. Therefore, pressure applied to the respective junction terminals 39 can be decreased to 10 gram or less as compared with that in the conventional art when the connector device 36 is to be connected to the printed circuit board 51.

Accordingly, it is possible to have the computer device 37 adequately exhibiting its high frequency property whereby it is possible to make data communication between the computer device 37 and a computer peripheral device at high speeds to efficiently drive the computer device 37.

Also, by reducing pressure applied to one junction terminal, it is possible to prevent damages to the respective junction terminals 39, thereby enabling achieving lengthening of the connector device 36 in service life. Further, since there is no need of increasing the thickness of gold plating applied on surfaces of the respective junction terminals 39, 44, and so it is possible to suppress an increase in manufacturing cost of the computer device 37.

Further, since an air is present in gaps between the respective junction terminals 39 and the respective contactors 41, it is possible to improve dissipation of heat radiated from the computer device 37.

Figure 11:
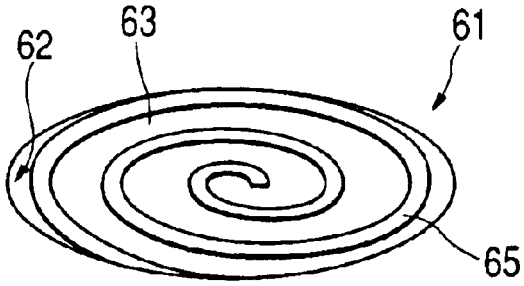
FIG. 11 is a perspective view showing a contactor constituting the connector device shown in FIG. 10.
Figure 12:
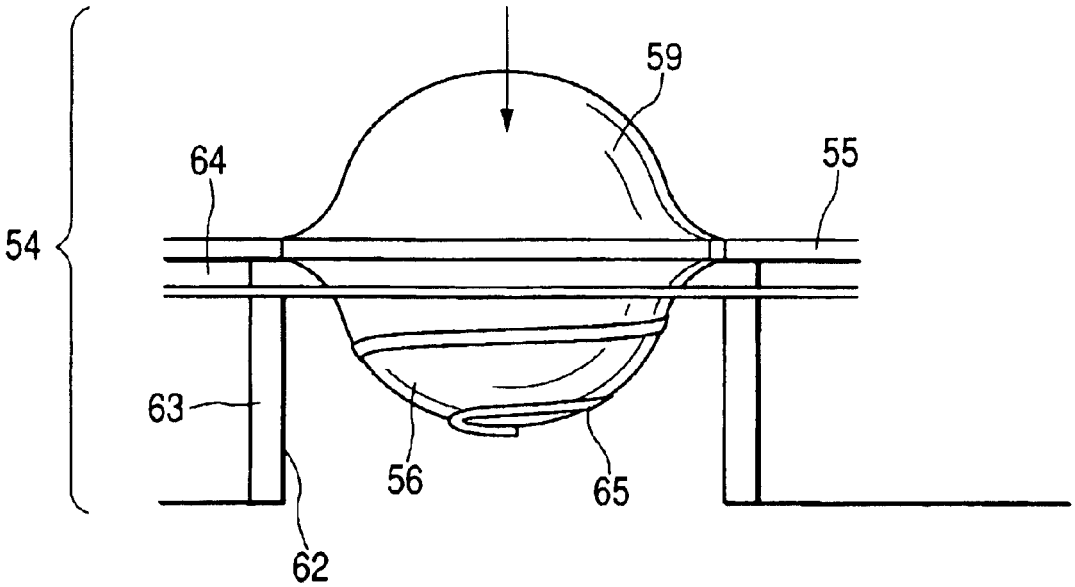
FIG. 12 is a cross sectional view showing the case where respective junction terminals of the connector device shown in FIG. 10 are inserted into respective contactors.

Subsequently, an explanation will be given to a fourth embodiment of a connector device according to the invention with reference to FIGS. 10 to 12. Also, the embodiment will be described by way of a connector device for electrically connecting a computer peripheral device and a computer device.

Figure 10:
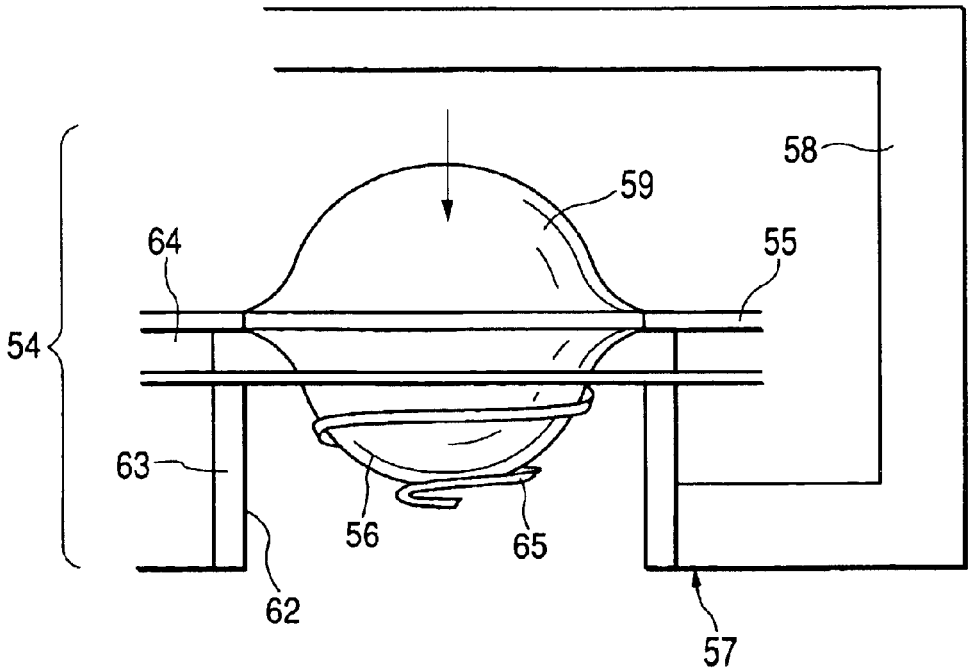
FIG. 10 is a cross sectional view showing a part of a connector device according to a fourth embodiment of the invention.

As shown in FIG. 10, a board 55 having a plurality of substantially semi-spherical junction terminals 56 arranged on a surface thereof is arranged in a housing 58 of a computer device 57, for which a connector device 54 according to the embodiment is used, and a plurality of substantially semi-spherical junction terminals 59 are arranged in positions corresponding to those positions, in which the respective junction terminals 56 are arranged, on the other surface of the board 55.

Also, a plurality of contactors 61 corresponding to the respective junction terminals 56 are arranged on that side of the board 55, on which the respective junction terminals 56 are arranged, in the housing 58.

These respective contactors 61 comprise a through-hole 62, which is circular in planar shape as shown in FIG. 10, and a conductive film 63 is formed on a side of the through-hole 62. And the contactors 61 comprise a spiral-shaped contact piece 65, which is disposed in an opening on a surface side of the respective through-holes 62, is spiral in planar shape and has a substantially bowl-shaped cross section, and an outer edge portion of the spiral-shaped contact piece 65 is connected to the conductive film 63.

Also, a spacer 64 made of an elastic material is arranged on a surface of the board 55, and the board 55 is arranged in the housing to abut against a surface of the spacer 64 for the interposers. At this time, surfaces of the respective junction terminals 56 are not in contact with surfaces of the contact pieces 65.

In addition, the remaining constitution of the connector device 54 according to the embodiment is the same as that of the first embodiment, and so an explanation therefor is omitted.

Subsequently, an explanation will be given to an operation of the second embodiment.

First, when a computer peripheral device is inserted into the housing 58 of the computer device 57, the respective junction terminals 59 are pushed toward the through-holes 62 by respective electrode terminals of the computer peripheral device. Correspondingly, the respective junction terminals 56 are also pushed inward in the through-holes 62 by the elasticity of the spacer 64, so that tip ends of the respective junction terminals 56 come into elastic contact with central portions of the respective spiral-shaped contact pieces 65. Subsequently, when the respective junction terminals 56 are pushed inward in the respective through-holes 62 as they are, a region of contact expands outward from a central portion of the respective spiral-shaped contact pieces 65 and the respective spiral-shaped contact pieces 65 flex concavely to be deformed in a manner to embrace the respective junction terminals 56. In this manner, the respective spiral-shaped contact pieces 65 wrap surfaces of the respective junction terminals 56 spirally whereby the respective junction terminals 56 and the respective spiral-shaped contact pieces 65 can be surely brought into contact with each other, so that it is possible to bring the personal computer 57 and the computer peripheral device into electrical contact with each other.

According to the embodiment, a linear dimension, over which the respective junction terminals 56 are connected to the spiral-shaped contact pieces 65 of the respective contactors 61, can be decreased to be made 100 $\mu$m or less, as compared with conventional insertion-type connectors, so that it is possible to reduce impedance, thereby enabling preventing the personal computer 57 from being degraded in high frequency property.

Accordingly, it is possible to have the personal computer 57 adequately exhibiting its high frequency property whereby it is possible to make data communication between the personal computer 57 and the computer peripheral device at high speeds to efficiently drive the computer device 57.

Also, since pressure applied to one junction terminal 56, 59 can be decreased to 10 gram or less as compared with that in the conventional art when the computer peripheral device and the computer device 57 are to be connected to each other, it is possible to prevent damages to the respective junction terminals 56, 59, thereby enabling achieving lengthening of the respective connector devices 54 in service life. Further, since there is no need of increasing the thickness of gold plating applied on surfaces of the respective junction terminals 56, 59, it is possible to suppress an increase in manufacturing cost of the connector device 54, in which the respective junction terminals 56 are arranged.

In addition, the invention is not limited to the embodiments but susceptible to various modifications at need.

The respective embodiments have been described with respect to a connector device for electrically connecting a computer device and a computer peripheral device to each other, but are not limited thereto.

In recent years, for example, semiconductor devices have been manufactured, in which a plurality of wafers, respectively, formed with an electric circuit are stacked in plural layers, and in semiconductor devices making use of respective junction terminals of conventional pin type, respective wafers are electrically connected together by means of wire bonding, in which four is a limit in the number of wafers stacked in a single package from the thickness point of semiconductor devices. Meanwhile, by using a connector device according to the invention for electric connection of respective wafers, four or more, for example, eight layers of wafers can be stacked on one another in a single package.

Also, a connector device according to the invention can be used in the case where respective films such as FPC or the like are electrically connected together.

Further, such connector device can be also made use of as a substitute socket for IC chips, which is used when respective junction terminals of an IC chip having a package such as PGA (Pin Grid Array), BGA (Ball Grid Array), or the like are to be connected to a mother board. Also, in the case where a package of an IC chip is BGA, only respective contactors according to the respective embodiments may be formed on a substitute socket to connect respective junction terminals of an IC chip to the respective contactors on the substitute socket.

Moreover, the respective junction terminals 4, 34, 39, 59 in the first to fourth embodiments and the respective junction terminals 9, 59 in the first, second and third embodiments are formed to be substantially semi-spherical in shape but not limited thereto, and may be, for example, cone-shaped and further pyramidal-shaped, such as trigonal pyramid, quadrangular pyramid, and so on.

As described above, with the connector device according to the invention, it is possible to have various devices or the like, in which the connector device is used, adequately exhibiting their high frequency properties whereby the devices can make data communication at high speeds to be efficiently driven. Also, since an air is present in gaps between respective junction terminals and respective contactors, it is possible to improve dissipation of heat radiated from the devices or the like.

With a further connector device according to the invention, damages to respective junction terminals can be prevented, so that it is possible to achieve lengthening of the respective junction terminals in service life, and since there is no need of increasing the thickness of gold plating applied on surfaces of the respective junction terminals, it is possible to suppress an increase in manufacturing cost of various devices, in which the connector devices are used.

With a further connector device according to the invention, since oxide films formed on surfaces of respective junction terminals and contact portions of respective contact pieces can be removed, it is possible to surely bring the respective junction terminals and the respective contact pieces into contact with each other, and it is possible to have various devices, in which the connector devices are used, exhibiting their high frequency properties further. As a result, the various devices can make data communication at higher speeds to be efficiently driven.

With a further connector device according to the invention, it is possible to surely bring respective pyramidal-shaped junction terminals and respective contact pieces into contact with each other, whereby it is possible to have various devices, in which the connector devices are used, exhibiting their high frequency properties further. As a result, the various devices can make data communication at higher speeds to be efficiently driven.

With a further connector device according to the invention, since respective junction terminals can be more surely brought into contact with contact portions of respective contact pieces, electric connection of the respective junction terminals and the respective contact pieces can be made more stable.

With a further connector device according to the invention, since a linear dimension, over which respective junction terminals are connected to the contactors, can be further made small, it is possible to reduce impedance, thereby enabling having a device adequately exhibiting its high frequency property. As a result, data communication can be made between the devices or the like and a computer peripheral device or the like at higher speeds and the devices can be efficiently driven.

With a further connector device according to the invention, since various devices or the like, in which the connector device is used, can be prevented from being degraded in high frequency property, it is possible to have the devices or the like adequately exhibiting their high frequency properties whereby the devices or the like can make data communication and can be efficiently driven. Also, since pressure applied to one junction terminal can be decreased as compared with that in the prior art when respective junction terminals are to be connected to respective contactors, it is possible to prevent damages to the respective junction terminals, thereby enabling achieving lengthening of the respective connector devices in service life and suppressing an increase in manufacturing cost of respective devices, in which the respective junction terminals are arranged.

With a further connector device according to the invention, since respective junction terminals are surely inserted into through-holes to be able to connect to respective contactors, it is possible to prevent the respective junction terminals and the respective contactors from being positionally offset from each other, thus enabling achieving more stable connection.

Further, with a further connector device according to the invention, since oxide films formed on surfaces of respective junction terminals and contact portions of respective contact pieces can be removed, it is possible to surely bring the respective junction terminals and the respective contact pieces into contact with each other, and it is possible to have various devices, in which the connector device is used, exhibiting their high frequency properties further. As a result, the various devices can make data communication at higher speeds to be efficiently driven.

What is claimed is:

1. A connector device comprising:

a plurality of convex-shaped junction terminals arranged on one surface of a board, a plurality of further junction terminals arranged in positions corresponding to those positions, in which the respective junction terminals are arranged, on the other surface of the board to be conducted to the respective junction terminals, and a plurality of contactors corresponding to the respective junction terminals, the respective contactors each including an opening and a contact piece arranged inside the opening and each contact piece comprising a contact portion to contact with each of the junction terminals, and a connecting portion to connect to a conductive film formed on an inner side surface of the opening when each of the junction terminals is inserted into the opening of each of the contactors, wherein the respective junction terminals are formed to be in the form of an elongated rectangular solid, and the respective contactors comprise a contact piece in the form of an elongated rectangular solid, arranged in an opened portion on a surface side of the opening to be perpendicular to each of the junction terminals and connected to a conductive film formed on an inner side surface of the opening.

2. The connector device according to claim 1, wherein the contact piece is arranged in a position disposed inside the opening the same dimension as that, by which each of the junction terminals projects from a surface of the opened portion on the surface side of the opening.

* * * * *